US005141000A

United States Patent [19]

Ruppert et al.

[11] Patent Number: 5,141,000

[45] Date of Patent: Aug. 25, 1992

[54] TOBACCO PRODUCT CONSISTING OF A PREFORMED TOBACCO STRAND AND A PREFORMED TUBULAR CIGARETTE WRAPPER

[76] Inventors: Heinrich W. Ruppert, Aixheimer Str. 12, 7218 Trossingen, Fed. Rep. of Germany; Klaus G. Gätschmann, Silcherallee 11, 7737 Bad Dürrheim, Fed. Rep. of Germany

[21] Appl. No.: 607,243

[22] Filed: Oct. 31, 1990

Related U.S. Application Data

[62] Division of Ser. No. 703,304, Feb. 20, 1985.

[51] Int. Cl.[5] ..... A24D 5/00; A24B 3/14

[52] U.S. Cl. ..... 131/77; 131/71; 131/360; 131/362; 131/364

[58] Field of Search ..... 131/77, 71, 360, 365, 131/362, 364, 358

[56] References Cited

U.S. PATENT DOCUMENTS 4,632,131 12/1986 Burnett et al. ..... 131/77

5,009,237 4/1991 Schmidt et al. ..... 131/71

*Primary Examiner*—V. Millin

*Assistant Examiner*—J. Doyle

*Attorney, Agent, or Firm*—Andrus, Sceales, Starke & Sawall

[57] ABSTRACT

A tobacco product consists of a preportioned tobacco strand (10) surrounded by a preformed tubular cigarette paper wrapper (11; 17). The tobacco strand is formed of individual tobacco fibers which are interconnected to each other by a binding agent to form a dimensionally stable tobacco strand. The binding agent and the fibers are each smokable but the outer surface of the tubular dimensionally stable tobacco strand is air pervious so that the strand as such is not directly smokable. The dimensionally stable strand (10) is inserted into the preformed tubular cigarette paper wrapper (11) to form a smokable cigarette. The one end of the strand is tapered for easier insertion of the strand into the preformed cigarette paper wrapper.

5 Claims, 2 Drawing Sheets

TOBACCO PRODUCT CONSISTING OF A PREFORMED TOBACCO STRAND AND A PREFORMED TUBULAR CIGARETTE WRAPPER

This is a division of application Ser. No. 06/703,304, filed Feb. 20, 1985.

The invention is directed to a tobacco product consisting of a pre-portioned tobacco supply surrounded by cigarette paper of tubular shape, and to a method of and a device for preparing such a tobacco product.

The preparation of cigarettes by the consumer has been known in various forms for a long time. This applies especially to the so-called self-rolling of cigarettes by the use of cigarette paper leaves with a paste applied to the edges. The roll-your-own cigarette making method requires a certain manual skill and is time-consuming. Even with skilled self-rollers, the cigarettes themselves differ widely as regards their size (diameter), stability (tautness) and degree of filling over the length of the cigarette, and they are but a primitive substitute for industrially made cigarettes. Furthermore, it is a drawback of manual rolling that crumbling of tobacco is unavoidable, which is undesirable from the aspect of tobacco yield. The same problems—though to a reduced extent—also exist when self-rolling devices are used. Similar aspects also hold for the other basic method of making cigarettes by oneself, i.e., for the self-filling of cigarettes. There are a number of more or less comfortable devices for filling empty cigarette tubes (normally filter-tipped) with tobacco, and all of the conventional devices have an elongate pressing chamber in common which is defined, on the one hand, by an approximately semi-circular fixed wall portion and, on the other hand, by an opposite semi-circular surface of a movable pressing member by means of which the pressing chamber may be closed after having been charged with tobacco, whereby a strand-like tobacco supply is produced. At one end of the pressing chamber a mounting funnel is provided for attaching and mounting an empty tubular cigarette wrapper. At the opposite end the pressing chamber is defined by a plunger-like tobacco ejector by means of which the tobacco supply may be transferred from the pressing chamber into the tubular cigarette wrapper (see for instance DE-OS 2,833,681; DE-PS 2,139,242; DE-PS 2,064,641; AT-PS 146,213; FR-PS 427,582; L- US-PS 638,904, or DE-OS 3,135,700). In order to improve the functional reliability, it is possible to have a semi-shell-like spoon mounted at the operative end of the ejector for promoting transfer of the tobacco supply from the pressing chamber into the tubular cigarette wrapper while at the same time maintaining the stability thereof.

In practical use, these known filling devices have proven more or less effective. However, they have the drawback that the purchase cost for the basic equipment is relatively high due to the frequently quite extravagant constructions and the mechanism for operating the ejector slide, so that in this respect a certain restraint on the consumer's side has to be overcome. Furthermore, during filling of the pressing chamber some contamination of the user's hands and of the environment with tobacco crumbs is unavoidable, but this is frequently felt to be a nuisance and in many cases stops the user from employing the device. Finally, manual filling makes it impossible to achieve an invariable degree of filling of the pressing chamber and thus of the tubular cigarette wrapper. The cigarettes that have been self-filled in this way therefore exhibit varying smoking characteristics, i.e., varying draw, taste and different smoking periods. In this respect the self-filled cigarette is similar to the self-rolled cigarette. Moreover, the content of harmful substances of the cigarette self-filled or self-rolled in the conventional way varies widely and is uncontrolled in accordance with the varying degree of filling of the cigarette wrapper.

From the CA-PS 771,426 a device for transferring a tobacco supply from a cylindrical wrapper into an auxiliary wrap has been known, which is intended for insertion in pipes. In this way the manual filling of pipes is to be avoided Also, cleaning of the pipes is to be facilitated by merely removing the auxiliary wrap including the remainders of the smoke.

For eliminating the above-mentioned deficiencies, both the DE-GM 8,326,921 and the DE-GM 8,309,186 propose a tobacco product for the preparation of cigarettes by the consumer, which is characterized by a pre-product in the form of an industrially prefabricated tobacco cartridge that cannot be smoked by itself, comprising an open-ended strand wrapper having its diameter matched to the tubular cigarette paper wrapper of the finished cigarette and a strand-like tobacco charge respectively corresponding to a cigarette portion, said tobacco charge being adapted to be transferred from the strand wrapper into an empty tubular cigarette paper wrapper by means of an associated plunger matched to the inner diameter of the strand wrapper. This tobacco product is suitable for use with conventional tubular cigarette wrappers for self-filling and also with conventional cigarette paper leaves for self-rolling. In accordance with the basic principle of this proposal, the consumer is presented with an exactly metered tobacco quantity in the form of a cigarette tobacco cartridge, said quantity corresponding to the content of a conventional industrial consumers' cigarette, and the tobacco content of said cartridge may be transferred in a simple way into a commercially available prefabricated tubular cigarette wrapper or into a tubular cigarette wrapper rolled and pasted from a cigarette paper leaf for self-rolling.

Although the last-mentioned proposal represents a considerable improvement over the above-mentioned prior art, it should not be overlooked that the tobacco cartridge comprises a wrapper, viz., a strand wrapper, of non-smokable material. With respect to the final product "cigarette", the strand wrapper constitutes a superfluous aid which may be used only once. Furthermore, the last-mentioned proposal requires further aids such as at least an ejector plunger for the transfer of the pre-portioned tobacco supply from the strand wrapper into the tubular cigarette paper wrapper. Manipulation of said ejector without further aids for inserting the charged tobacco cartridge into the empty tubular cigarette paper wrapper and for retaining the strand wrapper of the tobacco cartridge during transfer of the tobacco supply will be difficult even for experienced persons making their own cigarettes.

The present invention is based on the object of improving the last-mentioned proposal to the effect that the tobacco product is composed only of smokable ingredients with the exception of a possible filter tip, and that the self-making of cigarettes from these ingredients is basically possible even without any aids such as ejector plungers or the like. It is a further object of the invention to configure and insert the tobacco strand into the tubular cigarette paper wrapper in such a way that firm engagement therein is ensured and that also the use of conventional filling or tamping devices shall be possible.

The above object is solved in accordance with the invention by the features specified in the patent claims (individually and/or in the specified combination).

Similar to the proposal according to the DE-GM 8,309,186, the invention provides a system for the self-preparation of cigarettes by the consumer, which system in technical and economic respect makes optimum use of the advantages of the highly-developed and largely automated industrial cigarette-making methods for the requirements of the ever increasing number of self-rollers or self-fillers by offering them a pre-product which is suitable for simple finishing of the cigarette by the consumer. Moreover, the invention is also distinguished from the known solutions by the feature that auxiliary apparatus for the self-preparation of cigarettes are not necessarily required and that in particular the industrially prefabricated pre-products except the filter tip—if this is either provided or desired—are completely smokable, i.e., consist of smokable materials. Therefore they do not constitute a superfluous disposable aid. Also, it is no longer necessary to transfer the tobacco supply from the strand wrapper into the tubular cigarette paper wrapper, which operation indeed requires some skill especially when suitable aids or devices are not available. Moreover, in the invention the effects of moisture on the tobacco supply during transfer into a prefabricated tubular cigarette paper wrapper are no longer significant. The tobacco supply according to the invention will always retain is initial shape. When the tobacco supply of the known systems has become too dry due to influences of storage, weather or climate, it cannot be compressed in a predetermined way upon transfer from the strand wrapper into a prefabricated tubular cigarette paper wrapper by means of an ejector plunger, and consequently a so-called tobacco beard projects from the tubular cigarette paper wrapper. If, on the other hand, the tobacco supply is too moist, it will be excessivly compressed by the ejector plunger upon transfer from the strand wrapper into the tubular cigarette paper wrapper. In that case the forward end portion of the tubular cigarette paper wrapper will not contain any tobacco, and the aim of obtaining a self-made cigarette which corresponds to an industrially fabricated one has not been achieved.

In this embodiment the tobacco strand is entirely made of tobacco. Due to the porosity and/or the perforations, slits or the like provided in the tobacco foil used as strand wrapper, the strand wrapper as such cannot be smoked although consisting entirely of smokable material. However, following insertion into a tubular cigarette paper wrapper or following wrapping of the tobacco strand with cigarette paper in the roll-your-own mode, the tobacco strand will be smokable. The effect of the porosity or of the perforations, slits or the like will be lost by the closely engaging cigarette paper. The use of a tobacco foil as strand wrapper is highly advantageous also in respect of manufacturing technique, because the tobacco strand according to the invention may be made like a cigarette on conventional cigarette-making machines with a high degree of accuracy to size as regards the circular cross-section matched to the tubular cigarette paper wrapper. In external appearance the tobacco strand looks like a cheroot or a corresponding cigar, the difference being that the tobacco foil is air permeable so that the tobacco strand as such cannot be smoked. Preferably, a maximum air permeability of the outer strand wrapper is desirable. What should be ensured only is that the inherently loose tobacco supply is held together by the strand wrapper in a dimensionally stable way. In extreme cases, therefore, the strand wrapper may also be of net-like configuration.

For passionate self-rollers of cigarettes who use cigarette paper leaves, one end of the tobacco strand may be provided with a conventional filter tip.

As already explained above, it is an important feature in the presentation of a tobacco supply in the shape of a dimensionally stable tobacco strand, which is matched to the tobacco content of the finished cigarette and as such cannot be smoked, but which consists entirely of smokable material, that said tobacco strand after transfer into a prefabricated tubular cigarette paper wrapper should be safely retained therein, especially in close-fitting engagement with the inside of the tubular cigarette paper wrapper.

The last-mentioned configuration of the tobacco strand is especially suitable for use in conventional filling or tamping devices for tubular cigarette paper wrappers, including a pressing chamber in which the tobacco strand, prior to being transferred into the tubular cigarette paper wrapper, is radially compressed to about the internal diameter of the tubular cigarette paper wrapper. Preferably, compression to an outer diameter of the tobacco strand takes place, which is slightly smaller than the inner diameter of the tubular cigarette paper wrapper. Inside the tubular cigarette paper wrapper the tobacco strand may then expand radially into closefitting relationship therewith, so-that it will be retained securely and in smokable condition.

Thus, the tubular cigarette paper wrapper is filled with at least two tobacco strand sections of approximately equal length. With this embodiment the smoker may determine from the very beginning the quantity to be smoked, i.e., may reduce it to a predetermined fraction such as one-half by filling the tubular cigarette paper wrapper e.g. with only one tobacco strand section and separating, preferably tearing, the excessive cigarette paper. When the consumer wishes to smoke only part of a conventional cigarette, the remainig part of the cigarette will automatically be lost.

The tobacco strand may also have greater length than the tobacco receiving volume of the tubular cigarette paper wrapper. Preferably, the tobacco strand is at least twice the length of the tobacco receiving volume of a tubular cigarette paper wrapper, so that at least two tubular cigarette paper wrappers may be pushed onto the tobacco strand and the latter may be separated at the connecting point between the two tubular cigarette paper wrappers. In this way it is possible to self-roll at least two cigarettes simultaneously.

To facilitate insertion of the tobacco strand according to the invention into a prefabricated tubular cigarette paper wrapper, a funnel-like sleeve is especially suitable which with its smaller-diameter end may be attached to the open end of the tubular cigarette paper wrapper, wherein the inner diameter of said end is approximately equal to and preferably slightly smaller than the inner diameter of the tubular cigarette paper wrapper. The inserting funnel is an auxiliary device of the simplest kind. Insertion is further facilitated by the feature that the inserting funnel is provided at its smaller-diameter end with a cylindrical sleeve portion adapted to be inserted into the open end of the tubular cigarette paper wrapper. Preferably, the length of the cylindrical sleeve portion is selected such that the tubular cigarette paper wrapper which is pushed over the sleeve portion may easily be retained between two fingers, preferably between forefinger and thumb, upon insertion of the tobacco strand into the tubular cigarette paper wrapper. This means that the length of the cylindrical sleeve portion should be about 10 mm. Preferably, the outer surface of the cylindrical sleeve portion has a slight conical taper towards the free end remote from the funnel portion, whereby insertion of the sleeve portion into the tubular cigarette paper wrapper is facilitated.

In order to ensure a snug fit of the tobacco supply within the tubular cigarette paper wrapper, the inside of the smaller-diameter end of the inserting funnel is provided with means for slitting or tearing the tobacco strand upon insertion into the tubular cigarette paper wrapper along the outer surface of the strand or along the strand wrapper, said means being formed by one or several inwardly projecting blades, needle-like projections, or the like. Thereby the loose tobacco supply will expand somewhat in radial direction within the tubular cigarette paper wrapper and will be securely held within said wrapper.

The insertion funnel may also be provided with a reservoir, preferably a capillary reservoir, for a wetting liquid such as water, including means communicating with the inside of the inserting funnel for the purpose of wetting the tobacco strand pushed through the inserting funnel. Thereby the tobacco strand will experience a certain "swelling" inside the tubular cigarette paper wrapper, whereby it is likewise securely held within said wrapper.

To facilitate insertion of the tobacco strand into a prefabricated tubular cigarette paper wrapper, the tobacco strand may have a slight conical taper on one of its end portions. In that case an inserting funnel of the described kind is still less necessary.

Finally, it should be noted that the tobacco strand configured in accordance with the invention may be used without any difficulty also with conventional filling or tamping devices and self-rolling devices. This is neither provided nor possible in the case of tobacco cartridges having strand wrappers of non-smokable material.

Below, preferred embodiments of the invention will be described in detail with reference to the drawing, in which FIG. 1 is an exploded perspective view of a system for hand-making a cigarette in accordance with a preferred embodiment of the invention for use in conjunction with prefabricated tubular cigarette paper wrappers of the conventional type as used by persons who fill their own cigarettes;

Figure 1:
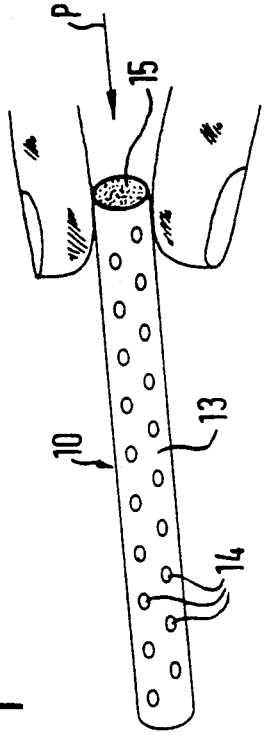
Figure 2:
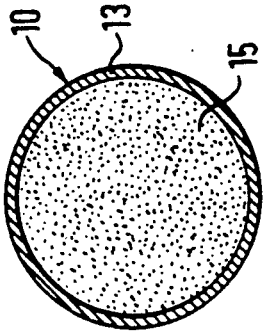
FIG. 2 is a cross-sectional view through a strand of tobacco according to FIG. 1 at an enlarged scale.

FIG. 1 illustrates an industrially prefabricated dimensionally stable strand of tobacco 10 associated with a likewise industrially prefabricated tubular cigarette paper wrapper 11 with a filter tip 12 as used conventionally by persons who fill their own cigarettes. The essential element of the system is the dimensionally stable tobacco strand, which cannot be smoked outside of the tubular cigarette paper wrapper 11 but for the rest consists entirely of smokable material. In the example according to the embodiment shown in FIGS. 1 and 2 the strand of tobacco 10 comprises a strand wrapper 13 of thin tobacco foil material provided with perforations 14. As shown in FIG. 1, the perforations 14 extend over the entire length of the tobacco strand 10. Preferably, the perforations 14 are approximately uniformly distributed over length and circumference of the tobacco strand 10. Instead of perforations it is also possible to use a porous tobacco foil material as the strand wrapper 13. The strand wrapper 13 contains a strand-like tobacco core 15 inserted by the manufacturer. The packing density of the tobacco core 15 within the strand wrapper 13 corresponds approximately to that of an industrially made cigarette. The length of the tobacco strand corresponds approximately to the length of the tobacco-containing volume 16 of a commercially available tubular cigarette paper wrapper 11. The outer diameter of the tobacco strand is slightly smaller, preferably about 1/20 to 3/10 mm smaller, than the inner diameter of the tubular cigarette paper wrapper 11 so that it may be inserted or pushed into the wrapper 11 without any difficulty. The quantity of the tobacco core 15 corresponds to the dense packing of the tubular cigarette paper wrapper 11 desired for the finished cigarette in accordance with a normal industrially made cigarette, as has been explained above. To match the free cross-section of the tubular cigarette paper wrapper 11, the cross-section of the tobacco strand 10 is circular over the entire length thereof so that it may be inserted into the tubular cigarette paper wrapper without any damage thereto and in close-fitting relationship with the inside of the tubular cigarette paper wrapper.

Figure 4:
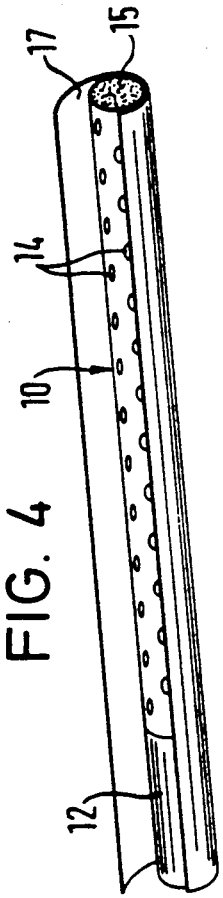
FIG. 4 illustrates the use of the system according to the invention in conjunction with cigarette papers of the kind conventionally used by self-rollers, also in a perspective view.

Instead of using a tobacco foil material for forming the strand wrapper 13 it is also possible to use porous cigarette paper and/or such cigarette paper provided with perforations, slits or the like. It is furthermore conceivable that the strand wrapper is configured as a net or as an air-permeable film-like coating. What has to be ensured merely is that the strand wrapper consists of smokable material and is air permeable over the entire length thereof such that smoking of the tobacco strand like a cigarette is impossible. The system according to the invention is also suitable for use in conjunction with cigarette paper, especially cigarette paper leaves 17, as used by self-rollers in the conventional manner. This type of use is illustrated in FIG. 4, in which the same or corresponding parts have been given the same reference numerals as in FIGS. 1 and 2. A conventional cigarette paper leaf 17 is wrapped about the prefabricated tobacco strand 10 of the invention and is made to adhere in the usual way. It is a special feature of the embodiment of FIG. 4 that the left-hand end face of the tobacco strand 10 has a filter tip 12 of conventional kind fitted thereto such that tobacco strand 10 and filter tip 12 constitute an integral pre-product. This is wrapped as a whole with the cigarette paper leaf 17.

It will be apparent that with the system according to the invention no strand wrapper will be left over as disposable part. Insofar the system of the invention represents a considerable advance over the prior known solutions with respect to consumption of material and with respect to the way of making and handling.

Figure 3:
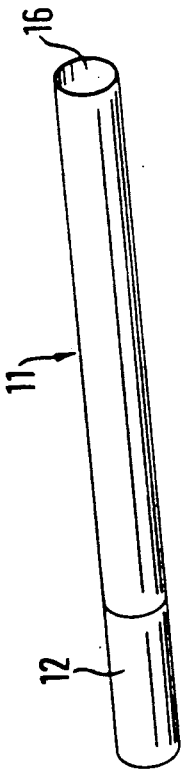
FIG. 3 is a device for facilitating insertion of a strand of tobacco according to the invention into a prefabricated tubular cigarette paper wrapper including a filter tip.
Figure 3:
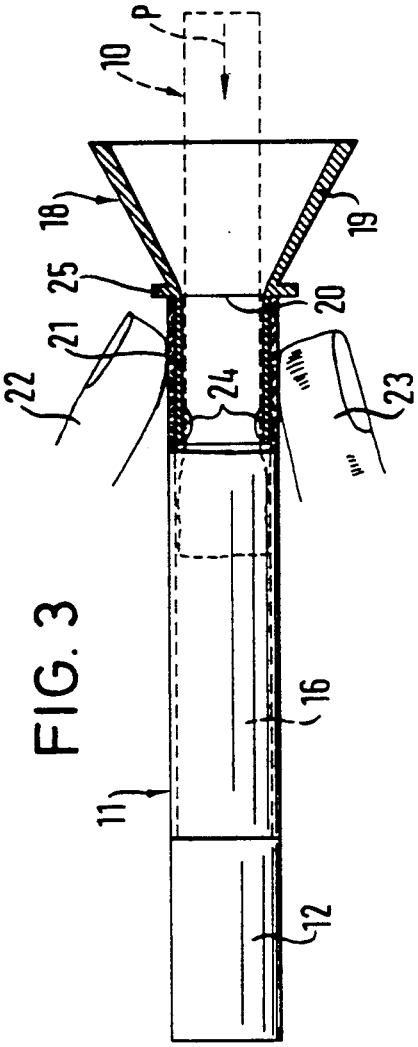

Referring to FIG. 3, self-rolling of a cigarette with the aid of the system of the invention and using an inserting funnel referenced 18 will be explained. The inserting funnel 18 comprises a funnel portion 19 and at its smaller-diameter end 20 a cylindrical sleeve portion 21 onto which the tubular cigarette paper wrapper 11 is pushed. The length of the sleeve portion 21 is about 8 to 12 mm, preferably about 10 mm, so that the tubular cigarette paper wrapper 11 which is slid thereon may conveniently be clamped or retained between two fingers, preferably between forefinger 22 and thumb 23, on the sleeve portion 21 of the inserting funnel 18 during insertion of the tobacco strand 10 into the still empty tubular cigarette paper wrapper 11. Insertion of the tobacco strand 10 into the tubular cigarette paper wrapper 11 is effected in the direction of the arrow "P" both in FIG. 1 and in FIG. 3.

A special feature of the inserting funnel is constituted by the knife-like protrusions 24 disposed on the inside of the cigarette or inside the end of the cylindrical sleeve portion 21 remote from the funnel portion 19; these protrusions 24 slit the outer strand wrapper 13 of the prefabricated tobacco strand 10 upon insertion thereof into the tubular cigarette paper wrapper 11 through the inserting funnel 18, so that the tobacco charge 15 may expand radially outwardly inside the tobacco receiving volume of the tubular cigarette paper wrapper 11, whereby it is securely held inside the tubular cigarette paper wrapper 11 in close-fitting relationship. The embodiment illustrated in FIG. 3 is provided with two diametrally disposed separating knives 24. Basically, a single separating knife will be sufficient. Preferably, three separating knives are provided which are disposed approximately equidistantly about the circumference and each of which is configured like a razor blade. Instead of the separating knives 24 it is also possible to provide needle-like projections which slit or tear the strand wrapper 13 open. The separating means will also be advantageous when the tobacco strand is held together by basically smokable binding agents interconnecting the tobacco fibres to form a dimensionally stable tobacco rod. A slight radial expansion of the tobacco strand inside the tubular cigarette paper wrapper will be sufficient to ensure reliable support thereof inside the wrapper.

To facilitate application of the inserting funnel 18 or sleeve portion 21 to the open end of the empty tubular cigarette paper wrapper 11, the outer surface of the sleeve portion 21 is preferably provided with a slight taper towards the free end thereof. Besides, the wall thickness at least of the cylindrical sleeve portion 21 is designed to be minimum. It amounts to about 0.15 to 0.3 mm. The dimensional stability of the sleeve portion 21 is ensured by the circular cross-section and by the junction to the funnel portion 19, which preferably has a somewhat greater wall thickness. The inserting funnel 18 may be made of stainless steel plate or of plastics material. The interior transition between the cylindrical sleeve portion 21 and the funnel portion 19 (in the region of the smaller-diameter end 20 of the funnel portion 19) is rounded, whereby the tobacco strand 10 may be inserted without difficulty through the inserting funnel 18 into the tubular cigarette paper wrapper 11. In the region of the smaller-diameter end 20 of the funnel portion 19 or, respectively, in the region of the joint between the cylindrical sleeve portion 21 and the funnel portion 19 there is provided an external annular flange 25 serving as an abutment for the tubular cigarette paper wrapper 11 which has been slid over the sleeve portion 21.

Figure 5:
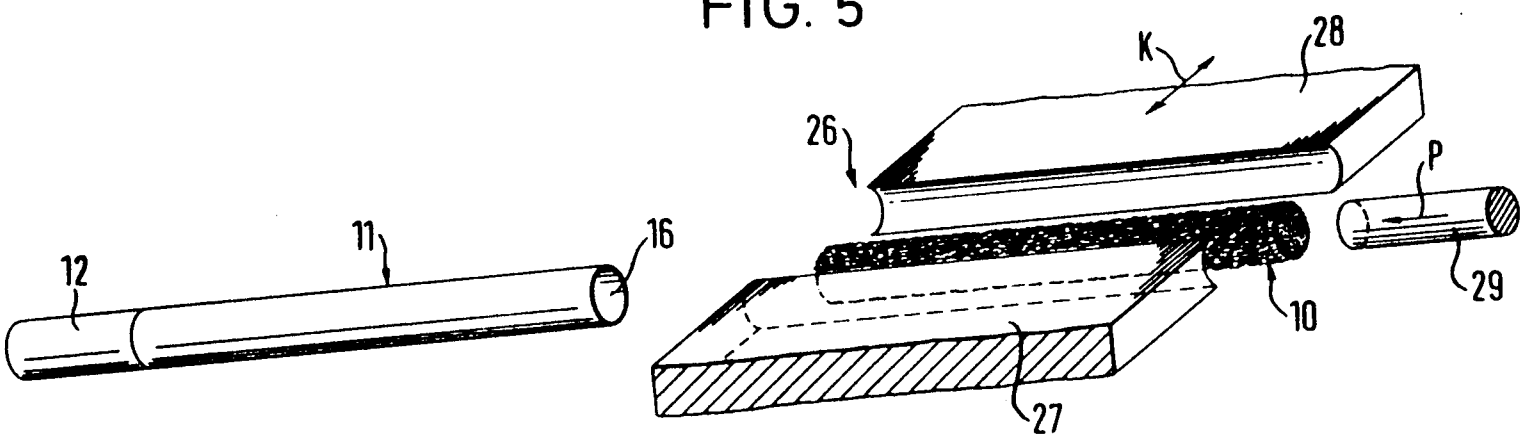
FIG. 5 is a view similar to FIG. 1, in which a conventional filling device is used.

FIG. 5 shows an industrially prefabricated dimensionally stable tobacco strand 10 associated with a likewise industrially prefabricated tubular cigarette paper wrapper 11 including a filter tip 12 according to FIG. 1. In the example illustrated by the embodiment of FIG. 5, the tobacco strand 10 shall consist only of tobacco fibres which are held together by a conventional binding agent to form a dimensionally stable tobacco rod. The outer diameter of the tobacco rod is selected to be somewhat greater, preferably about 5 to 10% greater, than the inner diameter of the tubular cigarette paper wrapper 11, so that the rod may be transferred into the tubular cigarette paper wrapper 11 while being radially compressed. To this end the tobacco rod is placed in a pressing chamber 26 of a conventional filling or tamping device for tubular cigarette paper wrappers and is compressed therein in radial direction, i.e., it is given an outer diameter which is preferably somewhat smaller than the inner diameter of the tubular cigarette paper wrapper 11. Subsequently, the thus compressed tobacco rod is transferred by means of a plunger-like ejector 29 into the tubular cigarette paper wrapper 11, which is attached to the open end of the pressing chamber 26 FIG. 5 is a highly schematic view showing only part of the tamping device, as the latter is one which is known per se. As an example therefor, reference shall be made to the DE-PS 2,139,242 or the DE-PS 2,064,641 or the DE-OS 2,833,681. Thus, the pressing chamber 26 shown in FIG. 6 is defined in a manner known per se by a stationary first half-shell 27 and a pressing bar 28 associated therewith and constituting a second half-shell, said pressing bar being supported in the body (not shown) of the tamping device for reciprocating movement in the direction of the arrow "K".

Within the scope of the invention other solutions are also conceivable, in which the tobacco strand is longitudinally divided, so that the cross-section of each part corresponds to a preferably even part of the cross-section of the tubular cigarette paper wrapper. In that case the tobacco strand may be composed of two strand halves, of three or more strand segments or telescoped strand wrappers. When the tubular cigarette paper wrapper is to be filled, two, three or more strand segments will have to be used correspondingly.

Similarly, it is conceivable that the cross-section of the tobacco strand is a multiple of the cross-section of the tubular cigarette paper wrapper; for instance, it may be twice the cross-section of the wrapper, in which case the cross-section of the tobacco strand preferably corresponds to the figure "8". Before use, the tobacco strand is broken apart along a connecting web or the like so that two single tobacco strands are formed each of which may be used to fill a tubular cigarette paper wrapper; because of the possibly formed burr, the bars had better be wrapped in a cigarette paper leaf. Similarly, it is conceivable that the tobacco strand comprises three or more single strands disposed either in radial relationship or about a central tobacco strand.

Basically, it is also conceivable that the tobacco strand 10 has polygonal cross-section, especially triangular, rectangular or hexagonal cross-section, or has oval or trapezoidal cross-section or the like, preferably such that the correspondingly shaped tobacco strand may be given a cross-section, particularly by compression (e.g. in the pressing chamber 26 of FIG. 5), which substantially completely fills the cross-section of the tubular cigarette paper wrapper.

To summarize, the following advantages are obtained with the system of the invention:

exact pre-portioning of the tobacco by industrial preparation;

invariable taste;

invariable smoking characteristics (smoking period, draw);

invariable predetermined content of harmful substances, based on a given tubular cigarette paper wrapper;

self-making of cigarettes by employing a conventional tamping device for tubular cigarette paper wrappers;

no disposable strand wrapper; and more favourable tax-based valuation as compared to industrially made cigarettes. The system according to the invention is also suitable, for instance, for the self-production of cigars or the like.

All of the features disclosed in these papers are claimed as being essential to the invention insofar as they are novel over the prior art either individually or in combination.

We claim:

1. In combination, an outer preformed wrapper formed of a smokable material and which is essentially air impervious and having a diameter corresponding to the finished cigarette, a preformed cylindrical tobacco member formed of individually tobacco fibers, at least one binding agent securing said fibers to each other to form a dimensionally stable tobacco member having said fibers forming a smooth outer surface of said tobacco member, said binding agent and said fibers being inherently smokable, said outer surface of said tobacco member being air pervious whereby said tobacco member is non-smokable as formed, said tobacco member having a length of least corresponding to the finished cigarette and adapted to form the tobacco filling of the finished cigarette, said stable tobacco member having a cross-section essentially corresponding to the tobacco receiving space in a finished cigarette and said preformed outer wrapper whereby said stable tobacco member when inserted in said preformed wrapper is in snug engagement therewith, said outer wrapper being formed of a fully smokable material and being air-impermeable whereby said cylindrical tobacco member is smokable only when combined with said preformed outer wrapper.

2. The combination of claim 1 wherein said tobacco member includes tobacco fibers, said binding agent securing said fibers to each other to form a dimensionally stable tobacco member having said fibers forming a smooth outer surface of said stable tobacco member, said binding agent and said fibers being inherently smokable.

3. The combination of claim 1 wherein said preformed outer wrapper is formed of cigarette paper.

4. The combination of claim 4 wherein said stable tobacco member has an approximately conical taper on at least one end.

5. The combination of claim 1 wherein said stable tobacco member has cross-section slightly smaller in the range of about 1/20 and 3/10 mm than the inner diameter of said preformed outer wrapper and establishing said close-fitting engagement of said outer wrapper and said stable tobacco member upon said direct insertion of said stable tobacco member in said outer wrapper.

* * * * *

UNITED STATES PATENT AND TRADEMARK OFFICE

CERTIFICATE OF CORRECTION

PATENT NO. : 5,141,000

DATED : August 25, 1992

INVENTOR(S) : HEINRICH W. RUPPERT ET AL

It is certified that error appears in the above-identified patent and that said Letters Patent is hereby corrected as shown below:

Claim 1, col. 10, line 3, after "length" delete "of" and substitute therefor ---at---; Claim 4, col. 10, line 25, after "claim" delete "4" and substitute therefor ---3---.

Signed and Sealed this

Eighth Day of March, 1994

*Attest:*

*Attesting Officer*

BRUCE LEHMAN

*Commissioner of Patents and Trademarks*